United States Patent [19]

North

[11] Patent Number: 4,902,198

[45] Date of Patent: Feb. 20, 1990

[54] APPARATUS FOR FILM COOLING OF TURBINE VAN SHROUDS

[75] Inventor: William E. North, Winter Springs, Fla.

[73] Assignee: Westinghouse Electric Corp., Pittsburgh, Pa.

[21] Appl. No.: 238,942

[22] Filed: Aug. 31, 1988

[51] Int. Cl.[4] ..... F01D 5/18

[52] U.S. Cl. ..... 415/115; 415/116

[58] Field of Search ..... 415/115, 116, 170 R, 415/134, 138

[56] References Cited

U.S. PATENT DOCUMENTS

| | | | |
|---|---|---|---|
| 3,519,366 | 7/1970 | Campbell | 415/138 |
| 3,542,483 | 11/1970 | Gagliardi | 415/136 |
| 3,752,598 | 8/1973 | Bowers et al. | 415/115 |
| 3,938,906 | 2/1976 | Michel et al. | 415/139 |
| 3,947,145 | 3/1976 | Michel et al. | 415/217 |
| 3,975,114 | 8/1976 | Kalkbrenner | 415/217 |
| 4,650,394 | 3/1987 | Weidner | 415/115 |
| 4,688,988 | 8/1987 | Olsen | 415/116 |
| 4,720,236 | 1/1988 | Stevens | 415/116 |
| 4,767,260 | 8/1988 | Clevenger et al. | 415/115 |

*Primary Examiner*—Robert E. Garrett
*Assistant Examiner*—John T. Kwon
*Attorney, Agent, or Firm*—K. Bach

[57] ABSTRACT

A gas turbine of the type having high pressure air supplied to the cavity formed by the inner shrouds of the turbine vanes is provided with film cooling of the shrouds. A manifold supplies high pressure cooling air to portions of the gaps between inner shrouds not otherwise supplied and intermittent reliefs in the strip seal between shrouds regulates the leakage of this air, over the outer surfaces of the shrouds.

14 Claims, 3 Drawing Sheets

FIG. 4
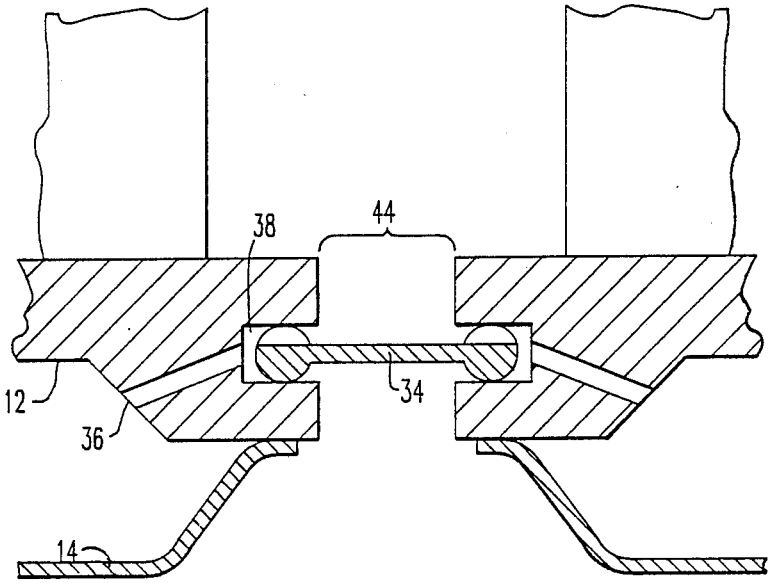
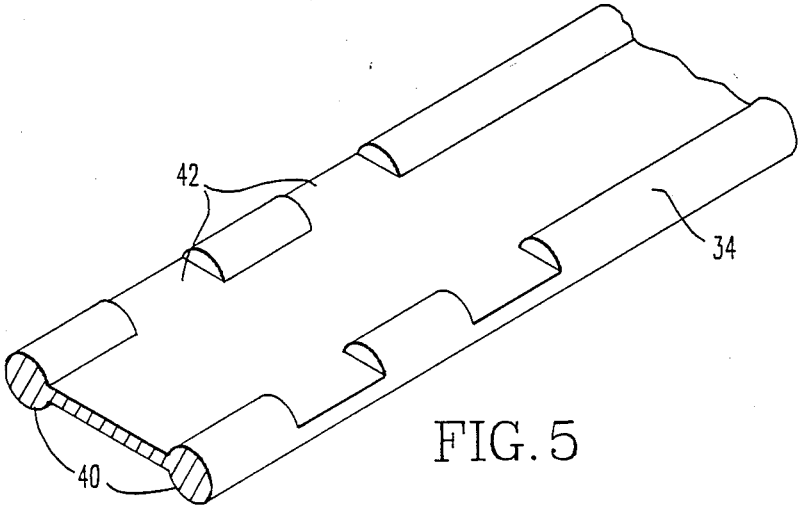
FIG. 5

APPARATUS FOR FILM COOLING OF TURBINE VAN SHROUDS

BACKGROUND OF THE INVENTION

1. Field of the Invention

The present invention generally relates to gas turbines. More specifically, the present invention relates to an apparatus and method for supplying film cooling to the inner shrouds of the turbine vanes.

To achieve maximum power output of the turbine it is desirable to operate with as high a gas temperature as feasible. The gas temperatures of modern gas turbines are such that without sufficient cooling the metal temperature of the flow section components would exceed those allowable for adequate durability of the components. Hence, it is vital that adequate cooling air be supplied to such components. Since to be effective such cooling air must be pressurized, it is typically bled off of the compressor discharge airflow thus bypassing the combustion process. As a result, the work expended in compressing the cooling air is not recovered from the combustion and expansion processes. It is, therefore, desirable to minimize the use of cooling air to obtain maximum thermodynamic efficiency, and the effective use of cooling air is a key factor in the advancement of gas turbine technology. The present invention concerns the supply and control of film cooling air to the inner shrouds of the turbine vanes.

2. Description of the Prior Art

The hot gas flow path of the turbine section of a gas turbine is comprised of an annular chamber contained within a cylinder and surrounding a centrally disposed rotating shaft. Inside the annular chamber are alternating rows of stationary vanes and rotating blades. The vanes and blades in each row are arrayed circumferentially around the annulus. Each vane is comprised of an airfoil and inner and outer shrouds. The airfoil serves to properly direct the gas flow to the downstream rotating blades. The inner and outer shrouds of each vane nearly abut those of the adjacent vane so that, when combined over the entire row, the shrouds form a short axial section of the gas path annulus. However, there is a small circumferential gap between each shroud.

Generally high pressure air is present in the annular cavity formed by the inner surface of the inner shrouds. This is so in the first vane row because it serves as the entrance to the turbine section and hence is immediately connected to a plenum chamber containing compressor discharge air awaiting introduction into the combustion system. As a result of this arrangement high pressure compressor discharge air fills the cavity formed between the inner shrouds of the first row vanes and the outer surface of the housing which encases the shaft in this vicinity. In the vane rows downstream of the first row a somewhat different situation exists. To cool the rotating discs of the blade rows immediately upstream and downstream of the vane row, cooling air is supplied to the cavity formed by the inner shrouds and the faces of the adjacent discs.

Leakage of the high pressure air in these cavities into the hot gas flow results in a loss of thermodynamic performance. Hence means are employed to restrict such leakage. Since the pressure of the hot gas flow drops as it traverses downstream through each succeeding row in the turbine, the natural tendency of the high pressure air in these cavities is to leak out of the cavity by flowing downstream through the axial gap between the trailing edge of the inner shroud and the rim of the adjacent rotating disc. This is prevented by a radial barrier extending circumferentially around the annular cavity. In the first vane row this barrier comprises a support rail, emanating radially inward from the inner shroud inner surface, which serves to support the vane against the housing encasing the shaft. Although a hole may be provided in the support rail allowing high pressure air to flow across it, a containment cover affixed to the inner surface of the inner shroud prevents the high pressure air from entering the shroud cavity downstream of the barrier. In rows downstream of the first row, the barrier comprises a similar support rail to which is affixed an interstage seal.

A second potential leakage path of the high pressure air in the shroud cavity is through the circumferential gaps between adjacent inner shrouds. In the past such leakage has been prevented by strip seals disposed in slots in the edges of the inner shrouds forming the gaps. In earlier turbine designs leakage past these seals resulted in a thin film of cooling air flowing over the outer surface of the inner shroud. This film cooling was sufficient to prevent overheating of the inner shrouds. However, as advances in gas turbine technology allow increasingly higher hot gas temperatures, it may be anticipated that the leakage past the seals will become insufficient, especially in the portion of the shroud downstream of the radial barrier, where the pressure of the air, and hence the leakage rate, is lower. In such advanced turbines overheating can occur on the first vane row in the portion of the inner shroud downstream of the radial barrier if adequate cooling is not provided. Since overheating of the shroud will cause its deterioration through corrosion and cracking, it results in the need to replace the vanes more frequently, a situation which is costly and renders the turbine unavailable for use for substantial periods.

It is therefore desirable to provide an apparatus and method which will achieve adequate film cooling of the inner shrouds in areas, such as downstream of the radial barrier, where the pressure of the air within the shroud cavity is low.

SUMMARY OF THE INVENTION

Accordingly, it is a general object of the present invention to provide a method and apparatus for film cooling of the inner shrouds of a gas turbine.

More specifically, it is an object of the present invention to provide a method and apparatus for film cooling the portion of the inner shroud not supplied with high pressure cooling air by regulating the leakage of high pressure air through the gaps between adjacent shrouds.

It is another object of the invention to distribute high pressure cooling air to the strip seals disposed in the gaps between shrouds and to regulate the leakage of the air across such seals.

Briefly, these and other objects of the present invention are accomplished in a gas turbine with a plurality of vanes, each vane having an inner shroud. There is a small circumferential gap between adjacent vanes and strip seals are disposed in slots in the shrouds to prevent leakage of air through the gaps. High pressure air is supplied to a portion of the cavity formed by the inner shrouds and a radial barrier prevents the high pressure air from reaching the portion of the shroud cavity downstream of the barrier. A containment cover affixed to each inner shroud allows high pressure air to flow through holes in the radial barrier to an opening in the inner shroud downstream of the barrier, so as to supply the vane airfoil with cooling air.

In accordance with one important aspect of the invention, a plurality of holes are provided extending from the slots retaining the strip seals to the portion of the inner surface of the shroud encompassed by the containment cover. Thus the containment cover serves to manifold high pressure air to these holes and thence the slots retaining the strip seals.

In accordance with another important aspect of the invention, the sealing surfaces of the strip seal are intermittently relieved to regulate the leakage of high pressure cooling air across the seals. This leakage provides film cooling to the inner shroud.

BRIEF DESCRIPTION OF THE DRAWINGS

FIG. 4 is a cross-section of the inner shroud taken through line 4—4 of FIG. 2;

FIG. 5 is a perspective view of the strip seal.

DESCRIPTION OF THE PREFERRED EMBODIMENTS

Figure 1:
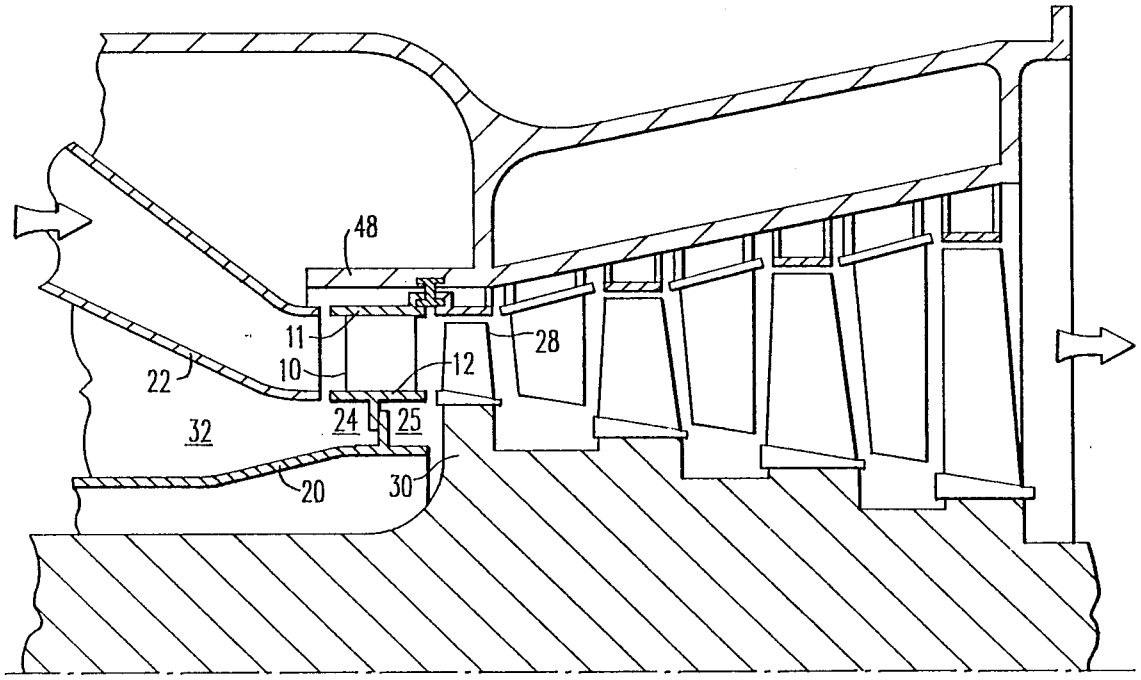
FIG. 1 is a longitudinal cross-section of the turbine section of a gas turbine.
Figure 2:
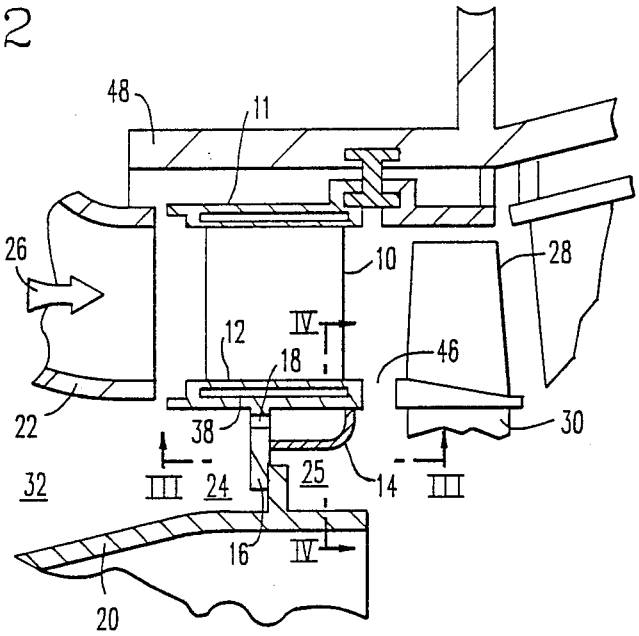
FIG. 2 shows a portion of the longitudinal cross-section of FIG. 1 in the vicinity of the first row vanes.

Referring to the drawings, wherein like numerals represent like elements, there is illustrated in FIG. 1 a longitudinal section of the turbine portion of a gas turbine, showing the turbine cylinder 48 in which are contained alternating rows of stationary vanes and rotating blades. The arrows indicate the flow of hot gas through the turbine. As shown, the first row vanes 10 form the inlet to the turbine. Also shown are portions of the chamber 32 containing the combustion system and the duct 22 which directs the flow of hot gas from the combustion system to the turbine inlet. FIG. 2 shows an enlarged view of a portion of the turbine section in the vicinity of the first row vanes 10. As illustrated, the invention applies preferably to providing cooling air to the first row of shrouds, but is applicable to the other rows as well. At the radially outboard end of each vane is an outer shroud 11 and at the inboard end is an inner shroud 12. Each inner shroud has two approximately axially oriented edges 50 and front and rear circumferentially oriented edges. A plurality of vanes 10 are arrayed circumferentially around the annular flow section of the turbine. The inner and outer shrouds of each vane nearly abut those of the adjacent vane so that, when combined over the entire row, the shrouds form a short axial section of the gas path annulus. However, there are small circumferential gaps 44 between the approximately axially oriented edges 50 of each inner shroud and the adjacent inner shrouds, as seen in FIG. 4. A housing 20 encases the rotating shaft in the vicinity of the first row vanes. Support rails 16 emanating radially inward from each inner shroud support the vane against this housing.

High pressure air from the discharge of the compressor flows within the chamber 32 prior to its introduction into the combustion system. This high pressure air flows freely into a shroud cavity 24 formed between the inner surface of inner shrouds 12 and the shaft housing 20. Rotating blades 28 are affixed to a rotating disc 30 adjacent to the vanes. A gap 46 is formed between the down stream edge of the shroud 12 and the face of the adjacent disc 30. The support rails 16 provide a radial barrier to leakage of the high pressure air downstream by preventing it from flowing through the shroud cavity 24 and into the hot gas flow through the gap 46.

Referring to FIGS. 2–5, it is seen that hot gas 26 from the combustion system flows over the outer surfaces of the inner shrouds. Leakage of the high pressure air into this hot gas flow through the gaps 44 between shrouds is prevented by means of strip seals 34 of dumbbell-shaped cross section shown in FIGS. 4 and 5. There is one strip seal for each gap, the seal spans the gap and is retained in the two slots along the edges of adjacent shrouds forming the gap. The cylindrical portions 40 of the dumbbell shape run along the two longitudinal edges of the seal and reside in the slots 38. Since the diameter of the cylindrical portions is only slightly smaller than the width of the slot they provide a sealing surface.

Figure 3:
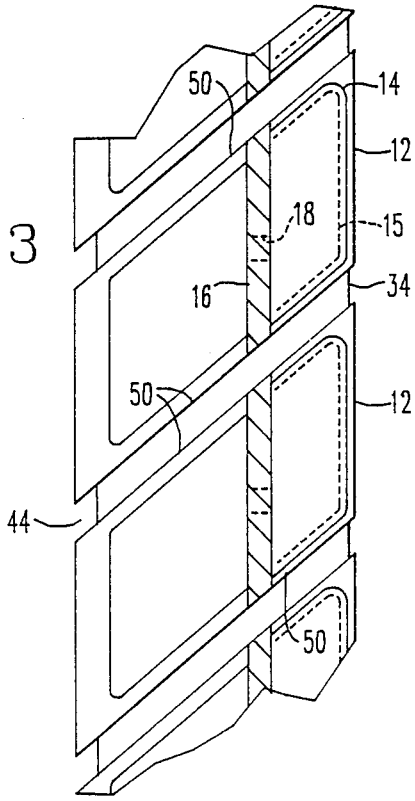
FIG. 3 is across-section taken through line 3—3 of FIG. 2 showing the inner shrouds of two adjacent vanes.

Holes 18 are provided in the support rail 16, one hole for each inner shroud. The holes extend from the front to the rear face of the rail and are equally spaced circumferentially around the rail. A containment cover 14 affixed to the inner surface of the inner shroud allows high pressure air to flow through these holes in the support rail and into the vane airfoil through an opening 15 in the inner shroud. The containment cover extends axially from the rear face of the support rail to near the rear circumferentially oriented edge of the shroud and circumferentially it approximately spans the two edges forming the gaps, as shown in FIG. 3.

The portion of the shroud cavity 25 downstream of the support rail 16 is not supplied with high pressure air from the compressor, as a result of being sealed off from chamber 32 by the support rail 16. Hence under the prior art approach very little cooling air can be expected to leak past the strip seal 34 to cool the portion of the inner shroud downstream of the support rail. In accordance with the present invention a means is provided for distributing high pressure air to the gap downstream of the support rail by providing a plurality of holes 36 extending from the slots 38 to the inner surface of the inner shroud encompassed by the containment cover 14 as shown in FIG. 4. These holes allow the containment cover to act as a manifold so that the holes 18 in the support rail 16 can supply high pressure air to the slots containing the seal 34. In accordance with another feature of the invention, a means is provided for regulating and distributing the leakage through the seal by providing intermittent reliefs 42 in the cylindrical portions 40 of the seal 34 downstream of the radial barrier, as shown in FIG. 5, the size and quantity of which determine the amount of leakage. The amount of leakage flow provided in this manner can also be controlled by varying the size of the holes 18 in the support rail 16. This leakage of high pressure air past the seals and through the circumferential gap between inner shrouds provides a film of air which flows over the outer surface of the inner shroud, thereby cooling it.

Many modifications and variations of the present invention are possible in light of the above techniques. It is therefore to be understood that within the scope of the appended claims, the invention may be practiced otherwise than as specifically described.

I claim as my invention:

1. A gas turbine of the type having a turbine cylinder containing a plurality of stationary vanes and rotating blades, said vanes and blades defining an annular flow path therebetween, said vanes circumferentially disposed in a row surrounding a rotating shaft and extending into said annular flow path;

each of said vanes having a radially inboard end, there being an inner shroud at each of said radially inboard ends;

each of said inner shrouds having first and second approximately axially oriented edges, said first and second edges of each pair of adjacent inner shrouds forming a circumferential gap, a slot being formed in each of said first and second edges;

each of said inner shrouds having inner and outer surfaces, said inner surfaces of said inner shrouds forming a shroud cavity;

a supply of high pressure air to said shroud cavity;

means for regulating the leakage of said high pressure air from said shroud cavity through each of said circumferential gaps between adjacent inner shrouds, characterized by:

a strip seal for each of said circumferential gaps, each of said strip seals having two longitudinal edges;

a sealing surface along each of said longitudinal edges, said sealing surfaces of each of said strip seals residing in said slots of two of said inner shrouds which are adjacent, one of said sealing surfaces residing in one of said slots and the other of said sealing surfaces residing in the other one of said slots whereby each of said strip seals spans one of said circumferential gaps; and a plurality of intermittent reliefs in each of said sealing surfaces, the size and quantity of which being variable to obtain the leakage flow desired.

2. A gas turbine according to claim 1 wherein each of said strip seals comprises a dumbbell-shaped cross-section having cylindrical portions, each of said cylindrical portions extending the length of each of said seals, the diameter of said cylindrical portions being approximately that of the width of said slots, thereby forming said sealing surfaces.

3. A gas turbine having a turbine cylinder containing a plurality of stationary vanes and rotating blades, said vanes and blades defining an annular flow path therebetween, said vanes circumferentially disposed in a row surrounding a rotating shaft and extending into said annular flow path;

each of said vanes having a radially inboard end, there being an inner shroud at each of said radially inboard ends;

each of said inner shrouds having first and second approximately axially oriented edges, said first and second edges of each pair of adjacent inner shrouds forming a circumferential gap, a slot being formed in each of said first and second edges;

each of said inner shrouds having inner and outer surfaces, said inner surfaces of said inner shrouds forming a shroud cavity;

a supply of high pressure air to said shroud cavity;

a radial barrier extending circumferentially around said shroud cavity and extending into said shroud cavity, said radial barrier restricting the flow of said high pressure air supplied to said shroud cavity from flowing downstream past said barrier, said radial barrier having front and rear faces, a portion of each of said circumferential gaps being downstream of said radial barrier;

means for distributing said high pressure air to said portion of each of said gaps downstream of said radial barrier, comprising:

means for regulating the leakage of said high pressure air from said shroud cavity through each of said circumferential gaps, said regulating means disposed in each of said circumferential gaps and retained in said slots in said first and second axially oriented edges of said inner shrouds;

a plurality of holes in each of said inner shrouds, a portion of said holes in each inner shroud extending from said inner surface to said slot in said first approximately axially oriented edge and remaining portion of said holes extending from said inner surface to said slot in said second approximately axially oriented edge;

a plurality of holes in said radial barrier, extending from said front to said rear face of said barrier; and a manifold for each of said inner shrouds, each of said manifolds connecting each of said holes in said radial barrier to said holes in its respective inner shroud.

4. A gas turbine according to claim 3 wherein the size of said holes in said radial barrier are variable to obtain the leakage flow desired.

5. A gas turbine according to claim 3 wherein each of said manifolds comprises a containment cover, each of said containment covers affixed to said inner surface of its respective inner shroud.

6. A gas turbine according to claim 3 wherein said radial barrier is comprised of a plurality of support rails, one of said support rails emanating from said inner surface of each of said inner shrouds.

7. A gas turbine comprising:

a plurality of vanes, said vanes arranged in a circular pattern so that each of said vanes has two other of said vanes adjacent to it, each of said vanes having a radially inboard end;

an inner shroud at said radially inboard end of each of said vanes, each of said inner shrouds having two approximately axially oriented edges, said approximately axially oriented edges of each pair of adjacent inner shrouds forming a circumferential gap, each of said shrouds having first and second portions;

a high pressure air supply, said high pressure air supplied to said first portion of each of said inner shrouds, said second portion of each of said inner shrouds not supplied with said high pressure air;

a plurality of slots, one of each of said slots disposed in each of said approximately axially oriented edges of said inner shrouds;

a strip seal for each of said circumferential gaps, each of said strip seals having two longitudinal edges, each of said edges forming a sealing surface, each of said strip seal disposed in its respective circumferential gap, each of said sealing surfaces being retained in said slots, whereby each of said strip seals spans its respective circumferential gap, a portion of each of said strip seals being located in said second portion of each inner shroud;

at least one relief in each of said sealing surfaces; and a plurality of manifolds connecting said high pressure air to said portion of each of said strip seals located in said second portion of each inner shroud.

8. A gas turbine of the type having a turbine cylinder containing a plurality of stationary vanes and rotating blades, said vanes and blades forming an annular flow path therebetween; a plurality of stationary members circumferentially arranged in a row surrounding a rotating shaft and forming a portion of said annular flow path, each of said stationary members being separated from each adjacent stationary member by a gap formed therebetween; and regulating means for regulating leakage through said gaps, said regulating means comprising:

a plurality of strip seals, each of said strip seals disposed in one of said gaps, each of said strip seals having first and second substantially longitudinal edges, a sealing surface along each of said longitudinal edges, each of said sealing surfaces having at least one relief, the size of said at least one relief being variable to obtain the degree of leakage desired, each of said sealing surfaces along said first longitudinal edges being in contact with one of said stationary members, each of said sealing surfaces along said second longitudinal edges being in contact with said adjacent stationary member forming said gap, whereby each of said strip seals spans one of said gaps.

9. A gas turbine according to claim 8 wherein said at least one relief comprises a plurality of intermittent reliefs in each of said sealing surfaces.

10. A gas turbine according to claim 8 further comprising first and second approximately axially extending edges formed in each of said stationary members, there being a slot in each of said axially extending edges, each of said longitudinal edges of said strip seals being disposed in one of said slots.

11. A gas turbine comprising a turbine cylinder containing an annular flow path, an annular cavity and a rotating shaft; a plurality of stationary members separating said annular flow path from said annular cavity, said stationary members circumferentially arrayed around said rotating shaft; each of said stationary members being separated from each adjacent stationary member by a circumferential gap; a radial barrier extending circumferentially around said annular cavity and dividing said annular cavity into first and second portions; first and second leakage paths between said second portion of said annular cavity and said annular flow path, said second leakage paths being formed by each of said circumferential gaps; means for regulating leakage of high pressure air through each of said second leakage paths, said regulating means comprising a seal with reliefs for leakage of air therethrough; a supply of high pressure air to said first portion of said annular cavity; and means for flow communication of said high pressure air between said first portion of said annular cavity and each of said second leakage paths, said flow communication means having means for preventing said high pressure air in said flow communication from communicating with said second portion of said annular cavity.

12. A gas turbine according to claim 11 wherein said stationary members comprise stationary vanes disposed in said annular flow path, each of said vanes having a radially inboard end, said stationary members forming an inner shroud at each of said radially inboard ends.

13. A gas turbine according to claim 11 further comprising a housing encasing said rotating shaft and forming a portion of said annular cavity, said radial barrier extending from each of said stationary members to said housing, thereby preventing flow of said high pressure air from said first to said second portions of said annular cavity.

14. A gas turbine according to claim 13 wherein said means for flow communication comprises a plurality of holes in said radial barrier and a manifold for each of said stationary members, each of said manifolds being in flow communication with one of said holes and one of said second leakage paths.

* * * * *